US005930960A

United States Patent [19]

Konnerth

[11] Patent Number: 5,930,960

[45] Date of Patent: Aug. 3, 1999

[54] PREFAB WALL ELEMENT WITH INTEGRATED CHASES

[76] Inventor: Alfred Konnerth, Iphöfer Weg 5, Mainbernheim, Germany, D-97350

[21] Appl. No.: 08/765,909

[22] PCT Filed: May 14, 1996

[86] PCT No.: PCT/EP96/02070

§ 371 Date: Jul. 7, 1997

§ 102(e) Date: Jul. 7, 1997

[87] PCT Pub. No.: WO96/36777

PCT Pub. Date: Nov. 21, 1996

[30] Foreign Application Priority Data

May 16, 1995 [DE] Germany ..... 295 08 061
Mar. 22, 1996 [DE] Germany ..... 196 11 388

[51] Int. Cl.[6] ..... E02D 19/00

[52] U.S. Cl. ..... 52/169.5; 52/220.7; 428/167

[58] Field of Search ..... 52/169.5, 169.8, 52/169.14, 220.7, 239, 241, 258, 220.3; 428/167

[56] References Cited

U.S. PATENT DOCUMENTS

| | | | |
|---|---|---|---|
| 3,353,315 | 11/1967 | Barker | 428/167 X |
| 4,070,719 | 1/1978 | Morgan | 428/167 X |
| 4,244,761 | 1/1981 | Remi et al. | 428/167 X |
| 4,439,966 | 4/1984 | Alles . | |
| 4,574,542 | 3/1986 | Raidt et al. | 52/169.5 |
| 5,056,281 | 10/1991 | McCarthy | 52/169.5 |
| 5,200,606 | 4/1993 | Horiki et al. | 428/167 X |
| 5,490,537 | 2/1996 | Lin | 52/220.7 |
| 5,511,346 | 4/1996 | Kenworthy | 52/169.5 |
| 5,592,794 | 1/1997 | Tundaun | 52/220.7 |

FOREIGN PATENT DOCUMENTS

| | | | |
|---|---|---|---|
| 394071 | 1/1992 | Austria | E04C 1/00 |
| 0565842 | 10/1993 | European Pat. Off. | E04C 2/52 |

*Primary Examiner*—Creighton Smith
*Attorney, Agent, or Firm*—Sheridan Ross P.C.

[57] ABSTRACT

The present invention concerns a device for forming finished walls in building carcasses or completed rooms with finished wall elements which can be assembled onsite in order to form partition walls and are provided with prefabricated ducts.

14 Claims, 4 Drawing Sheets

PREFAB WALL ELEMENT WITH INTEGRATED CHASES

FIELD OF THE INVENTION

The following invention relates to prefabed wall elements. The wall elements are generally installed in building shells and finished rooms. The modular prefab wall elements of the present invention are provided with prefabricated chases. It is these chases which facilitate assembly of the prefabricated wall structure.

BACKGROUND OF THE INVENTION

In the course of the past few decades a procedure for constructing buildings, in particular office buildings, has become widespread whereby one creates generally large-surface stories whose ceilings are supported by pillars and which have no layout of rooms through original masoned or cast walls. To obtain maximum flexibility in designing the particular stories one uses parting walls which usually consist of gypsum plaster boards backlined with insulating material. One can thus produce any desired layout of rooms, and furthermore change it later.

The disadvantage of such constructions is that the walls consisting of gypsum board and insulating material must be assembled and interconnected in an elaborate way at the site of their installation. In particular the laying of cable material behind the gypsum boards and the mounting of outlet boxes and the like are elaborate, time-consuming and destabilizing, which makes such parting walls expensive.

The present invention provides a new and unique way of forming partitioning walls, otherwise known as parting walls, which are easy to assembly and adapt to local site conditions encountered during the installation process. The present inventive prefab wall also permits easy installation of cables and the like, as well as the installation of outlet boxes and the like.

Prefab wall elements to be installed both in shells and in finished rooms are provided which are prefabricated in the desired dimensions and can be assembled into parting walls at the site of their installation. The inventive prefab wall element is adapted to local conditions in height by being cut off, and in width by conventional measures. The individual wall elements are interconnected by preferably perforated U-sections to be inserted into grooves formed at least on the lateral edges of the wall elements on the construction site. These U-sections are likewise adapted to the room height on site and fastened to ceiling and floor with connection angles. The individual wall elements can thus be mounted successively until they are connected to an opposite wall. The connection can be performed in the conventional manner, for example with gypsum plaster boards, or else with a specially designed fitting element.

The wall element is provided in different module widths suitable for building, preferably having a width of 62.5 cm at full room height. The wall element consists according to the invention of a core element either having a monolithic structure in the form of a foamed board of PU or PSD foam, a mineral wool compact or another suitable filler, or being formed as a compound element with e.g. horizontal and vertical mineral wool insulating strips applied to a carrier of gypsum, insulating material and/or cardboard. The wall surface is furthermore formed by a corresponding flat element or by a composition which can be of different materials and have different thicknesses according to requirements and demands on the surface.

The core element has a heat-insulating function according to the invention. Furthermore the core element is provided with at least one horizontal and a number of vertical chases whose form is production-dependent. The horizontal chases are preferably provided on one side of the core element and the vertical chases on the opposite side of the core element. If the core element is formed as a compound element, the horizontal and vertical chases can be formed in such a way that the insulating strips glued to the carrier material are spaced apart. If the core element has a monolithic structure, the horizontal and vertical chases are formed directly within the material of the core element.

The structure of the inventive wall elements including the horizontal and vertical chases in the particular core element greatly simplifies the installation of wires in an advantageous way, which is in turn reflected in a considerable time saving for installation. For electric installation one drills a hole with the diameter of the switch, outlet box or the like to be installed in the surface element at the place where the particular plug box is to be installed. Above the plug box one likewise drills a hole for an air-space feeder box at the height of a horizontal chase, thereby penetrating the core element material separating the particular horizontal and vertical chase, be it foam or carrier material of gypsum, etc., and producing a connection between the two chases permitting the drawn-in cable to be readily pushed to any desired place in the wall element.

It is possible to execute the wall elements in such a way that the wall surface elements can be removed upon first installation either completely or with respect to individual chases to facilitate the laying of wires. It is likewise possible to provide the prefab wall element exclusively with vertical chases, this embodiment being suitable in particular for use with suspended ceilings via which the particular cables are guided to the vertical chase in the desired wall element.

Finally a variant of the wall element is provided for application as a plasterboard on solid walls. The structure of this wall element for solid walls corresponds substantially to that of the wall elements described above, a core element again performing a heat-insulating function. Only one horizontal chase is preferably provided, being located between the vertical chases of the element at the upper end of the board. To make it easier to draw in wires horizontally, the horizontal chase is provided on each side with a thin, easily penetrated bar. The surface of the wall element for solid walls facing the particular room is covered in accordance with the wall elements described above with a wall surface element which can be of different materials and thicknesses according to requirements and demands on the surface.

BRIEF DESCRIPTION OF THE DRAWINGS

In the following a preferred embodiment will be described in connection with the enclosed drawings, in which:

FIG. 1 shows the embodiment of a wall element with 20 mm thick carrier board of insulating material 1 which is provided on one side with horizontal chases 2 and on the other side with vertical chases 3. In the shown embodiment horizontal and vertical chases 2 and 3 each have a width of 40 mm. In the shown embodiment the wall surface elements consist of 9 mm or 12.5 mm thick gypsum plaster boards 4. On the right-hand side of the wall element there is air-space feeder box 5 in the upper area and air-space plug box 6 in the lower area of the wall element on the same side of the wall element, each disposed in vertical chase 3. Cable 7 leads into air-space feeder box 5, being drawn through one of horizontal chases 2. Air-space feeder box 5 is connected with air-space plug box 6 via cable 8 which leads through vertical chase 3. The wall element is fixed between story ceiling 8 and story floor 11 or cast plaster floor 10 with the help of lower fastening angles 12 and upper fastening angles (not shown) directly below ceiling plaster 9.

FIG. 2 shows a horizontal section through a plurality of interconnected or yet to be interconnected wall elements according to FIG. 1. In addition to the features known from FIG. 1, FIG. 2 shows primarily tongue and groove stiffening sections 13 which engage in groovelike recesses 14 on both edges of the wall elements. Stiffening sections 13 permit the individual wall element modules to be assembled into a wall. The wall elements are connected to particular main walls 15, which are provided with plaster 16, directly on one side with the help of UW-sections which engage in recesses 14 in the particular edge of the connecting wall element. As likewise shown in FIG. 2, a length compensation can be performed conventionally, as shown, via gypsum plaster boards 9 mm thick in this case and corresponding fastening sections 19, suitable thermal insulation being inserted between gypsum plaster boards 18 for wall compensation.

FIG. 3 shows a monolithic core element of an embodiment of the wall elements. This monolithic core element can consist of a suitable foam and is provided, as shown, with vertical chases 3 on one side and horizontal chases 2 on the other side.

FIG. 4 shows a detailed representation of tongue and groove stiffening section 13 as mentioned above in connection with FIG. 2. Tubular elements or recesses 20 are formed in section 13 which serve as extensions of horizontal chases 2 of two wall elements to be connected with the help of section 13. The other half of section 13 is designed so as to form further vertical chase 3, as it were, thereby maintaining a continuous screen of vertical chases. Sections 13 are fastened according to FIG. 4 via fastening angles 21 which are anchored on the story ceiling and story floor.

FIG. 5 shows stiffening section 13 according to FIG. 4 in a lateral cross-sectional view, showing substantially the same elements.

FIGS. 6 and 7 show horizontal cross sections through the views of sections 13 according to FIGS. 4 and 5.

Figure 1:
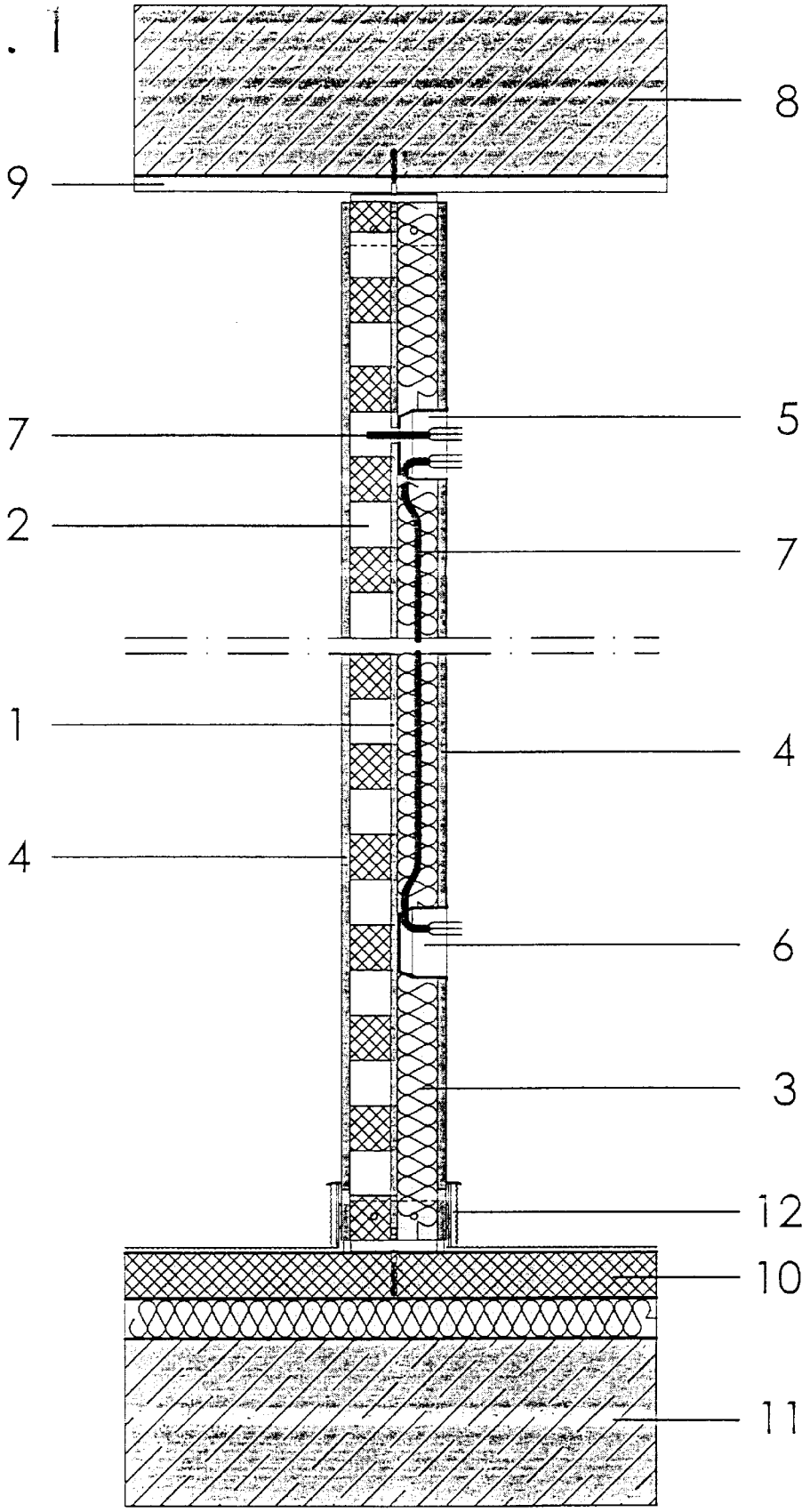
FIG. 1 shows a wall element in the installing situation.
Figure 2:
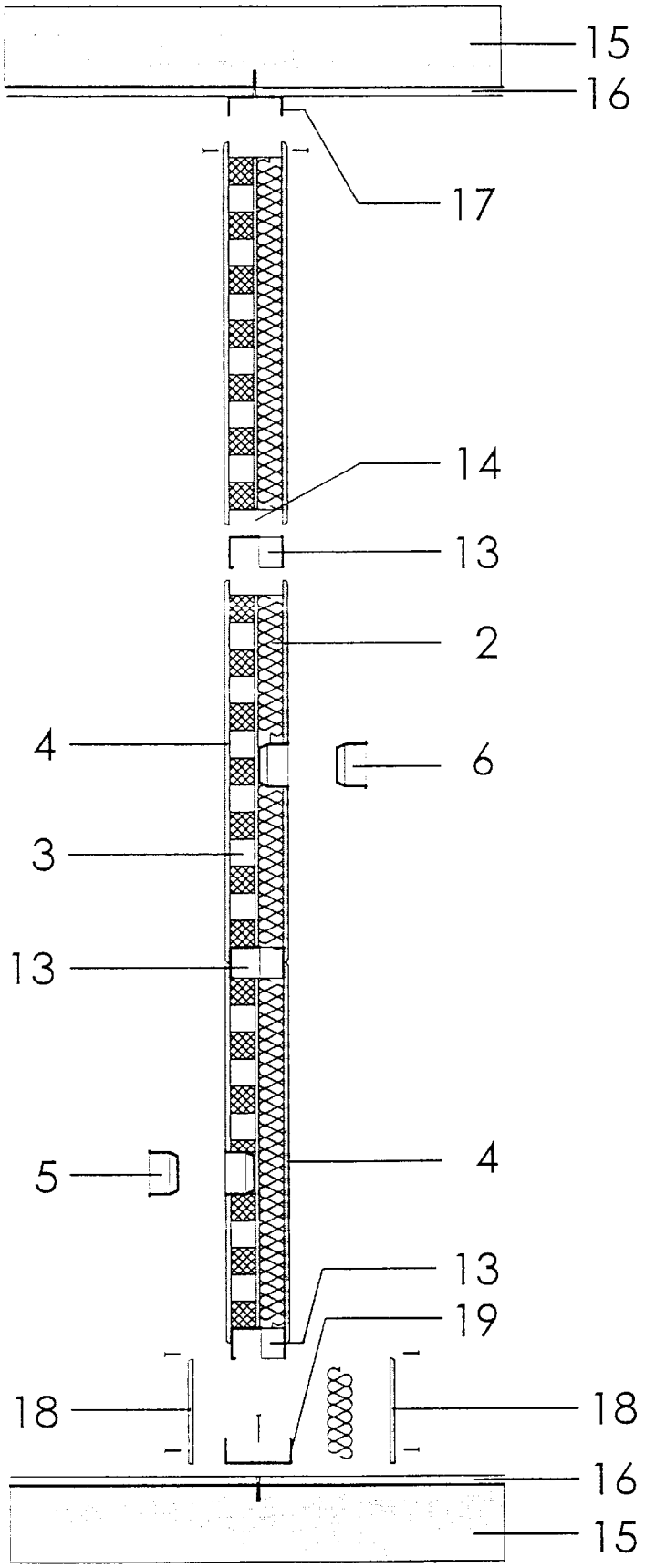
FIG. 2 shows a horizontal section through the wall element of FIG. 1.
Figure 3:
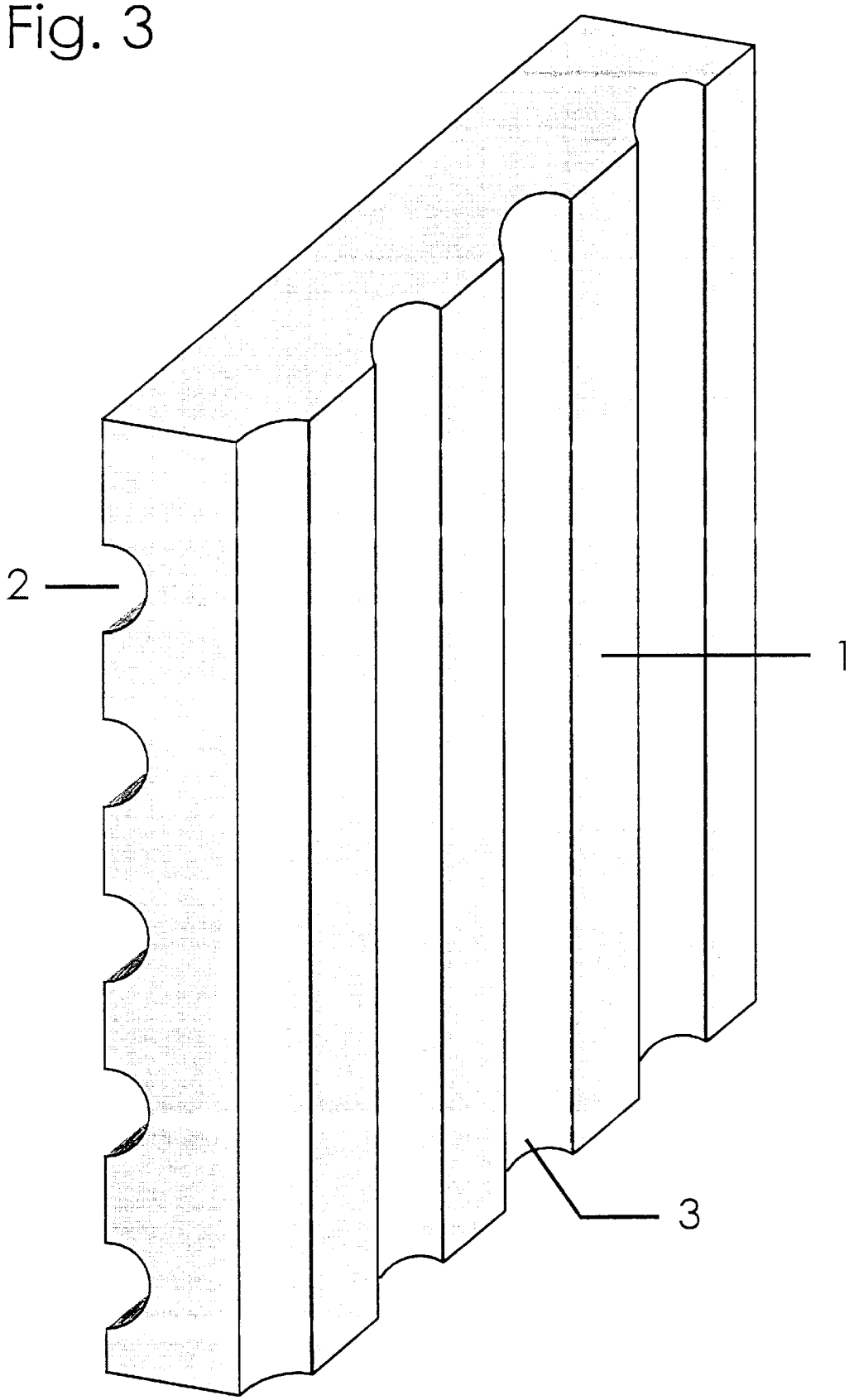
FIG. 3 shows a monolithic core element of a wall element.
Figure 4:
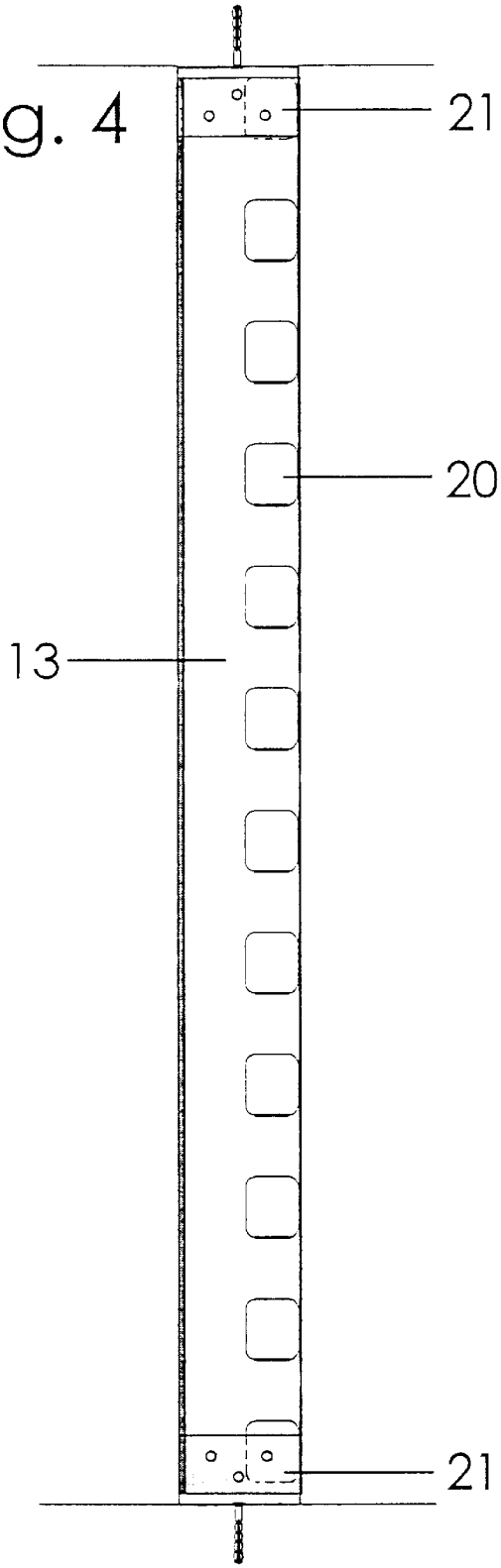
FIG. 4 shows a front view of a section for connecting wall elements.
Figure 5:
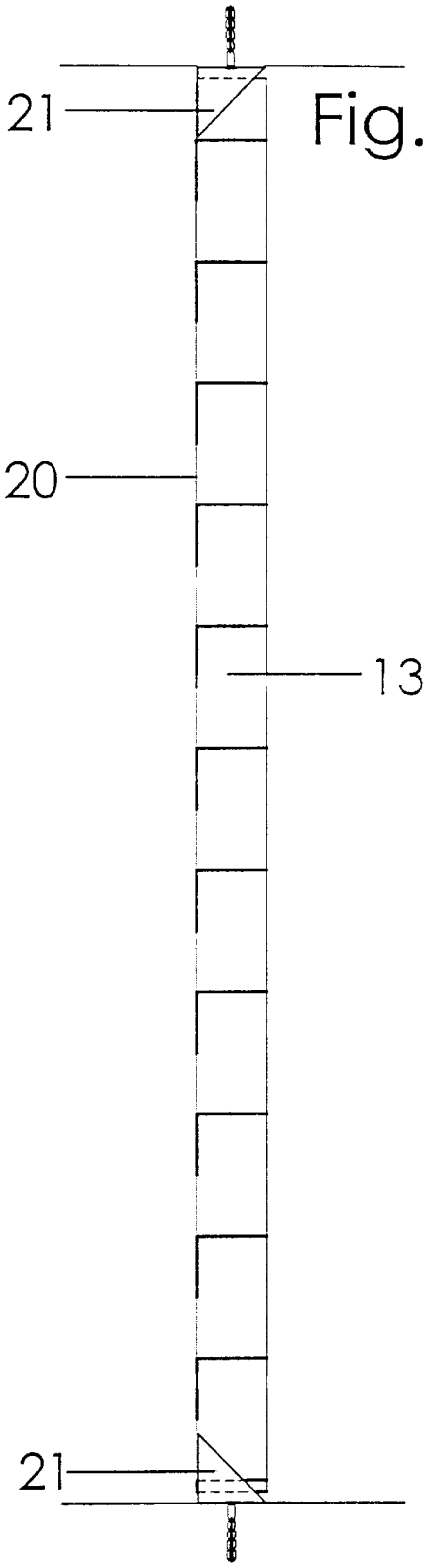
FIG. 5 shows a lateral sectional view through the connecting section of FIG. 4.
Figure 6:
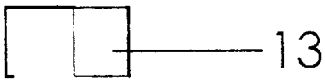
FIG. 6 shows a horizontal cross section through the section of FIG. 4.
Figure 7:
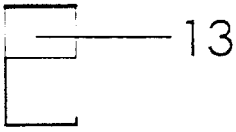
FIG. 7 shows a horizontal cross section according to FIG. 5.

I claim:

1. A prefabricated interior wall panel to be installed in an interior of a building, comprising at least one modular interior wall member having lateral edges and a plurality of prefabricated chases, wherein a first prefabricated chases is oriented transversely to a second prefabricated chases, said modular interior wall member being capable of being assembled to form a parting wall in an interior of a building or mounted on preexisting solid walls in an interior of a building, wherein said lateral edges are groovelike to facilitate interconnection of at least several prefabricated interior wall panals, and further including a stiffening member whose dimensions correspond to and which are stiffening member whose dimensions correspond to and which are horizontal tubular recesses to interconnect said horizontal chase or vertical chases of one prefabricated interior wall panel to said horizontal chase or vertical chases of a second prefabricated interior wall panel.

2. The prefabricated interior wall panel of claim 1, wherein said plurality of chases are disposed vertically within said modular interior wall member and at least one chase is disposed horizontally in said modular interior wall member.

3. The prefabricated interior wall panel of claim 2, wherein said modular interior wall member has a core, said core being formed monolithically or as a compound and opposite sides of said core being provided with said horizontal and said vertical chases.

4. The prefabricated interior wall panel of claim 2, wherein said horizontal chase is disposed on one side of said modular interior wall member and said vertical chases are disposed on opposite side of said modular interior wall member.

5. The prefabricated interior wall panel of claim 3, wherein said core is formed of heat insulating material.

6. A prefabricated interior wall panel for installation in an interior of a building, comprising:

a modular core member having lateral edges and a plurality of prefabricated channels extending a length of the modular core member, wherein at least two of the plurality of prefabricated channels are oriented transversely to one another, and a stiffening member engaging at least one of the lateral edges to provide structural support to the modular core member, the stiffening member including a plurality of channels extending through the stiffening member in communication with at least one of the plurality of prefabricated channels.

7. The prefabricated interior wall panel of claim 6, wherein one of the at least two of the plurality of prefabricated channels extends horizontally and another of the at least two of the plurality of prefabricated channels extends vertically.

8. The prefabricated interior wall panel of claim 7, wherein said horizontal prefabricated channel is disposed on one side of said modular core member and said vertical prefabricated channel is disposed on an opposite side of said modular core member.

9. The prefabricated interior wall panel of claim 8, wherein said modular core member is formed of heat insulating material.

10. The prefabricated interior wall panel of claim 6, wherein at least one of said lateral edges is groovelike to facilitate interconnection of at least several prefabricated interior wall panels and wherein the stiffening member is engaeable with said at least one of said groovelike lateral edges.

11. The prefabricated interior wall panel of claim 6, wherein said plurality of channels interconnects said prefabricated channels with prefabricated channels of an adjacent prefabricated interior wall panel.

12. The prefabricated interior wall panel of claim 6, further comprising:

a U-shaped member connected to a structural member of said building for connecting at least one of the lateral edges to the structural member, wherein at least a portion of the prefabricated interior wall panel is received between the opposing edges of the U-shaped member.

13. A prefabricated interior wall panel for installation in an interior of a building, comprising:

a modular core member having lateral edges and a plurality of first prefabricated channels extending a first direction and a plurality of second prefabricated channels extending a second direction, the first and second directions being transverse to one another, wherein the first prefabricated channels and second prefabricated channels are located on opposing exterior surfaces of the modular core members; and a stiffening member engaging at least one of the lateral edges to provide structural support to the modular core member, wherein the stiffening member includes a plurality of recesses extending therethrough in communication with the plurality of first prefabricated channels.

14. The prefabricated interior wall panel of claim 13, wherein the first and second prefabricated channels are located in a central portion of the modular core member.

* * * * *